United States Patent [19]

Nash

[11] Patent Number: 5,019,859

[45] Date of Patent: May 28, 1991

[54] PROCESS CONTROL FOR HIGHLIGHT COLOR WITH DEVELOPER SWITCHING

[75] Inventor: Thomas W. Nash, Sodus, N.Y.

[73] Assignee: Xerox Corporation, Stamford, Conn.

[21] Appl. No.: 522,946

[22] Filed: May 14, 1990

[51] Int. Cl.[5] ..... G03G 21/00

[52] U.S. Cl. ..... 355/77; 355/208; 355/246; 355/326; 430/42

[58] Field of Search ..... 355/77, 208, 206, 219, 355/244, 245, 246, 326, 327, 328; 430/42

[56] References Cited

U.S. PATENT DOCUMENTS

| | | | |
|---|---|---|---|
| 4,553,830 | 11/1985 | Nguyen | 355/206 X |
| 4,710,785 | 12/1987 | Mills | 355/208 X |
| 4,754,301 | 6/1988 | Kasamura et al. | 355/245 |
| 4,777,510 | 10/1988 | Russel | 355/328 |
| 4,786,924 | 11/1988 | Folkins | 355/208 |
| 4,797,703 | 1/1989 | Guslits | 355/212 |
| 4,809,038 | 2/1989 | Yamamoto et al. | 355/327 |
| 4,811,046 | 3/1989 | May | 430/45 |
| 4,866,486 | 9/1989 | Higashio et al. | 355/326 |

*Primary Examiner*—R. L. Moses

*Assistant Examiner*—J. E. Barlow, Jr.

[57] ABSTRACT

Highlight color imaging apparatus and method for creating highlight color images that allows the inter-image areas to be used for developability or other control functions notwithstanding the necessity of developer switching. The black and highlight color images are separately formed and the order of image formation is one where the black image (B1) for the first copy is formed, followed by the highlight color image (C1) for the first copy; then the highlight color image (C2) for the second copy; then the black image (B2) for the second copy; then the black image (B3) for the third copy and finally the highlight color image (C3) for the third copy. With the foregoing order of image creation, developer switching is not required when two adjacent images are the same color. When developer switching is not required the inter-image area can be used for process control such as developability to form a test pattern thereat. Thus, in the example above, the area between the two adjacent color images (C1, C2) is available for forming a color test patch. Likewise, the area between the two black images (B2, B3), is available for forming a black test patch.

6 Claims, 1 Drawing Sheet

PROCESS CONTROL FOR HIGHLIGHT COLOR WITH DEVELOPER SWITCHING

BACKGROUND OF THE INVENTION

This invention relates generally to highlight color imaging and, more particularly, to the use of inter-image areas for process control such as developability.

In the practice of conventional xerography, it is the general procedure to form bi-level electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Multi-color imaging has also been accomplished utilizing basic xerographic techniques. In this instance, the foregoing process is essentially repeated for three or four cycles. Thus, the charged photoconductive surface is successively exposed to filtered light images. After each exposure the resultant electrostatic latent image is then developed with toner particles corresponding in color to the subtractive primary of the filtered light image. For example, when a red filter is employed, the electrostatic latent image is developed with toner particles which are cyan in color. The cyan toner powder image is then transferred to the copy sheet. The foregoing process is repeated for a green filtered light image which is developed with magenta toner particles and a blue filtered light image which is developed with yellow toner particles.

Each differently colored toner powdered image is sequentially transferred to the copy sheet in superimposed registration with the powder image previously transferred thereto. In this way, three or more toner powder images are transferred sequentially to the copy sheet. After the toner powder images have been transferred to the copy sheet, they are permanently fused thereto. The foregoing color imaging process is known as full color imaging.

Another color imaging process is known as highlight color imaging. In highlight color imaging two different color developers are customarily employed, usually black and some other color, for example, red.

Whether the imaging process results in single or multiple color images, developability controls are required in order to insure satisfactory operation of the development system. Such controls usually depend on a small developed image or test patch area located in the inter-document or inter-image areas for measuring developer performance. However, in a highlight color imaging system requiring developer switching the interdocument areas of conventional imaging surfaces are unavailable for creating these test patches. This is because developer switching using a conventional imaging surface results in unacceptable test patch development. Due to the time required for completing developer switching a test patch in the inter-image area cannot be satisfactorily developed by the appropriate developer. In fact, the patch is partially developed by both developer systems of a highlight color imaging system.

Developer switching is the process of activating and deactivating two or more developer housings. Switching can be accomplished by the timed disengagement of the developer housings from the charge retentive surface or through reverse rotation of the developer rolls designed for that purpose. Developer housing switching can also be effected through developer housing bias switching. Developer switching is necessary in order to preclude development of one image on the imaging surface with both developers.

Various prior art patents disclose developer switching. Exemplary of these are:

U.S. Pat. No. 4,811,046 granted to Jerome E. May on Mar. 7, 1989 and assigned to the same assignee as the instant invention which discloses a printing apparatus wherein the developer rolls of a selected developer housing or housings can be rotated in a contact preventing direction to permit the development of a tri-level images.

U.S. Pat. No. 4,809,038 granted to Yamamoto et al on Feb. 28, 1989 which discloses a color electrographic apparatus including a latent image forming device for forming plural electrostatic latent images respectively corresponding to image signals of different colors on the surface of a photoconductor, a plurality of toners of different colors each of which has the same polarity as the photoconductor, and a plurality of developing devices which are disposed in the vicinity of the photoconductor and each of which contain a colored toner for respectively developing the latest image without contact with the photoconductor under a direct electric field. A toner image is formed by a repeating cycle of making electric charges on the surface of the photoconductor, activating the latent image forming device so as to light expose an image corresponding to respective image signals of different colors on the surface of the photoconductor and activating a respective developing device so as to develop the exposed image by a respective toner corresponding to the image signal. Even further, a reversal flying preventing device is provided for preventing reversal flying of toner of the image from the photoconductor to one of the developing devices which is not developing as the image passes before the developing device.

U.S. Pat. No. 4,797,703 granted to Vladimir S. Guslits on Jan. 10, 1989 which discloses two development stations each having fixed stops at a predetermined position relative to a toning roller. The stations develop latent images on one surface of a flexible photoconductor, and two parallel rollers are located adjacent the other surface of the photoconductor. One roller or the other roller can deflect the photoconductor into an operative relationship with one or the other of the stations. The apparatus that moves the rollers engages the stops to precisely locate the photoconductor relative to the stations.

U.S. Pat. No. 4,754,301 granted to Kasamura et al on June 28, 1988 which discloses an image forming apparatus includes a plurality of the developing devices for developing the latent image formed on an image bearing member. The plural developing devices are each movable between its developing position for developing the latent image on the image bearing member and its retracted position away from the image bearing member. The image forming apparatus includes a shutter for selectively opening and closing the developing aperture of the developing device of one of the developing devices. The shutter opens and closes the developing aperture of said one of the developing devices in association with movement of the other developing device between the developing position and the retracted position.

The foregoing problem relating to the usage of inter-image areas could be obviated by using a larger charge retentive surface or photoreceptor to provide larger spacing in the interdocument area and/or an area at the edge of the photoreceptor for accommodating the test patch without being affected by developer switching. However, enlarging the photoreceptor reduces the manufacturing yield resulting in a substantial cost increase in an already expensive machine component.

BRIEF SUMMARY OF THE INVENTION

In accordance with the present invention, there is disclosed a method and apparatus for creating highlight color images with inter-image areas which are usable for developability or other control functions notwithstanding the necessity of developer switching.

To this end, the order in which the black and highlight color images are formed is rearranged from one of alternating from black to highlight color to black, etc. The black and highlight color images are separately formed and the order of image formation according to the present invention is one where, for example, the black image (B1) for the first copy is formed, followed by the highlight color image (C1) for the first copy; then the highlight color image (C2) for the second copy; then the black image (B2) for the second copy; then the black image (B3) for the third copy and finally the highlight color image (C3) for the third copy. With the foregoing order of image creation, developer switching is not required when two adjacent images are the same color. When developer switching is not required the inter-image area can be used for process control such as developability to form a test pattern thereat. Thus, in the example above, the area between the two adjacent color images (C1, C2) is available for forming a color test patch. Likewise, the area between the two black images (B2, B3) is available for forming a black test patch.

DETAILED DESCRIPTION OF THE PREFERRED EMBODIMENT OF THE INVENTION

Figure 1:
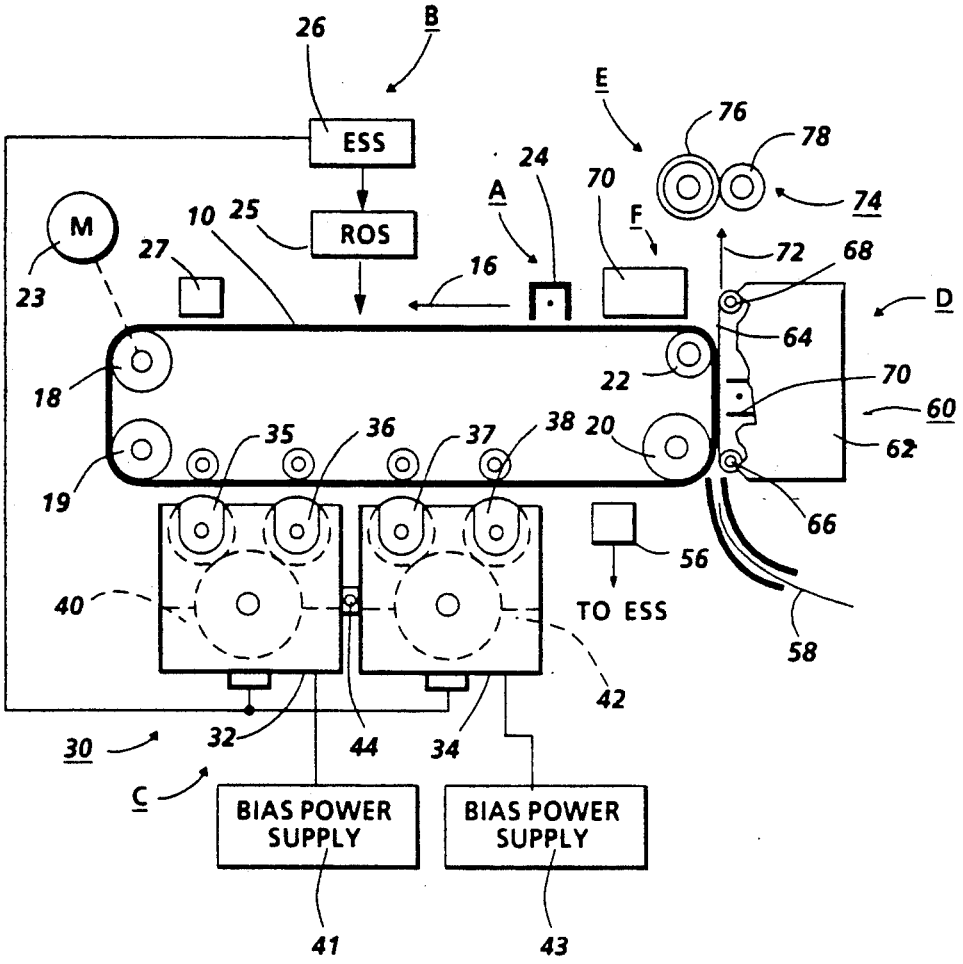
FIG. 1 is a schematic illustration of a highlight color printing apparatus.

As shown in FIG. 1, a printing machine incorporating the invention utilizes a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 19, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform predetermined negative potential. Any suitable control, well known in the art, may be employed for controlling the corona discharge device 24.

Next, the uniformly charged portions of the photoreceptor surface are advanced through exposure station B. At exposure station B, the uniformly charged belt photoreceptor or charge retentive surface 10 is exposed to a Raster Output Scanner (ROS). Variable information is written on the surface with the ROS 25, the output of the ROS being controlled by an Electronic Subsystem (ESS) 26. Successive bi-level images are formed on the imaging surface. Each bi-level image represents a complimentary part of a two color image to be developed with either black or a highlight color toner. A well controlled light source 27 serves to create a latent test patch image in the inter-image area between certain image pairs. The light source 27 is also controlled by the ESS 26.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

One housing e.g. 32 (for the sake of illustration, the first) contains magnetic brush developer with black toner 40 while the other housing 34 contains magnetic brush developer with the highlight color toner 42, for example, red. If desired, the black and color toners may be contained in the opposite housings.

Figure 2:
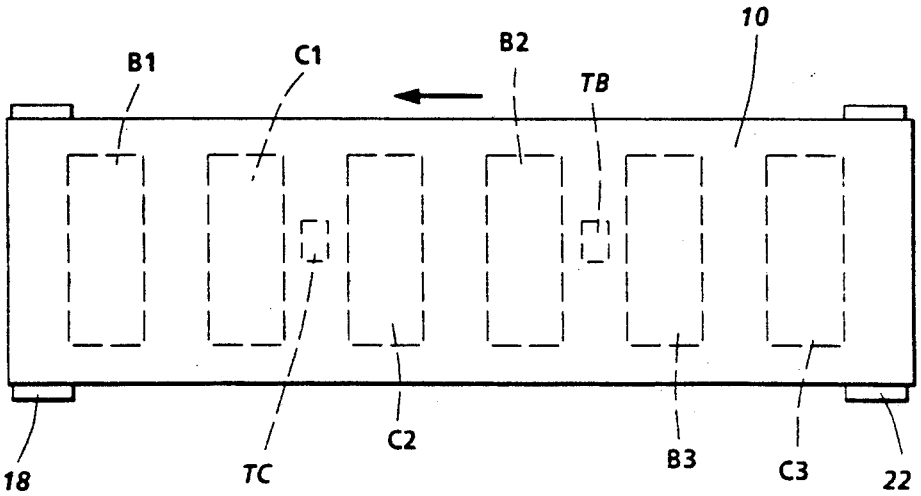
FIG. 2 is a schematic illustration of a charge retentive belt with a plurality of latent electrostatic images formed thereon.

As disclosed in FIG. 2, the order of image formation starts with the formation of a latent image, B1 which is developed using black toner from the housing 32. Then a latent image C1 is formed with the ROS and developed with color toner from the housing 34. The developer housings 32 and 34 are pivotally mounted to a pivot bar 44 for movement under the control of the ESS 26 toward and away from the belt 10 in order to effect developer switching in accordance with the color to be used in developing a particular image. As will be appreciated, developer housing switching is required to develop the images B1 and C1. First the housing 32 is positioned in development communication with the image B1 and then simultaneously moved away from the belt 10 while the housing 34 is moved into development communication with the image C1.

Subsequent to the formation of the image C1, a latent test pattern image, TC is formed which is developed with color toner from the housing 34. A latent image C2 is then formed on the belt 10 and developed with color toner form the housing 34. The formation of the test pattern image, TC with subsequent development thereof with color toner is made possible because developer switching is not necessary. As stated above, when two adjacent images are developed with the same color of toner, as in the case of images C1 and C2 developer switching is not required.

Next, a latent image, B2 is formed and developed with black toner. Since, the adjacent images, C2 and B2 are not the same color the developer switching is required. Accordingly, the inter-image area between the images C2 and B2 is not usable for creating a test pattern image.

A latent test pattern image TB is formed after the image B2 followed by the formation of a latent image, B3. In accordance with the invention, the images B2 and B3 and the test pattern image are developed with black toner from the housing 32. Finally, an image C3 is formed which is developed with color toner form housing 34. Again, developer switching is necessitated because the adjacent images B3 and C3 are developed with different toners.

The test pattern images, TB and TC are used to generate output signals indicative of toner condition in the respective developer housings 32 and 34. This is accomplished by sensing the density of the developed test patches using an infrared densitometer (IRD), 56. The generated signals are communicated to the ESS where they are compared to predetermined reference values for controlling the dispensing of toner into the developer housings 32 and 34 in a well known manner.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from stack into a chute which directs the advancing sheet of support material into contact with photoconductive surface of belt 10 in a timed sequence so that the toner powder images developed thereon contact the advancing sheet of support material at transfer station D.

A recirculating copy sheet structure 60 is positioned at the transfer station D. The structure 60 comprises a housing 62 incorporating a vacuum belt 64 entrained about a plurality of rollers including rollers 66 and 68. Each copy sheet 58 is moved into image transfer relationship with the belt 10 twice, once for transfer of the black image thereto and once for transferring the highlight color image thereto. Thus, the images B1 and C1 are first transferred to a copy sheet 58 followed by the transfer of images C2 and B2 to a subsequent copy sheet. Finally, the images B3 and C3 are sequentially transferred to still another copy sheet.

Transfer station D includes a corona generating device 70 which sprays ions of a suitable polarity onto the backside of belt 64. This attracts the charged toner powder images from the belt 10 to sheet 58. After transfer, the sheet continues to move, in the direction of arrow 72, onto a conveyor (not shown) which advances the sheet to fusing station E.

Fusing station E includes a fuser assembly, indicated generally by the reference numeral 74, which permanently affixes the transferred powder image to sheet 58. Preferably, fuser assembly 74 comprises a heated fuser roller 76 and a backup roller 78. Sheet 58 passes between fuser roller 76 and backup roller 78 with the toner powder image contacting fuser roller 76. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A cleaner housing 70 is disposed at the cleaner station F.

Subsequent to cleaning, a discharge lamp (not shown) floods the photoconductive surface with light to dissipate any residual electrostatic charge remaining prior to the charging thereof for the successive imaging cycle.

What is claimed is:

1. The method of creating toner images, said method including the steps of:

uniformly charging a charge retentive member;

exposing said charge retentive member to form a plurality of latent electrostatic images thereon; and developing a plurality of said latent electrostatic images with toners having different physical properties such that at least two adjacent images are developed with one toner having the same physical properties and two other adjacent images are developed with another toner having the same physical properties which are different from the physical properties of said one toner whereby developer switching is not required between adjacent images having the same physical properties.

2. The method according to claim 1 wherein the step of developing with toners having different physical properties comprises developing with different color toners.

3. The method according to claim 1 including the step of transferring a complimentary and a non-complimentary image to the same copy substrate.

4. The method according to claim 3 including the steps of:

exposing said charge retentive member to form a plurality of test pattern areas intermediate image areas having different physical properties.

5. The method according to claim 4 including the step of measuring the density of said test pattern areas to generate electrical output signals useful for adjusting toner concentration of the developer supplies.

6. The method according to claim 5 wherein said step of altering said uniform charge level is effected using a two level ROS.

* * * * *